US010755639B2

(12) United States Patent
Cha et al.

(10) Patent No.: US 10,755,639 B2
(45) Date of Patent: Aug. 25, 2020

(54) PIXEL UNIT, A DISPLAY APPARATUS HAVING THE SAME AND A METHOD OF DRIVING THE DISPLAY APPARATUS

(71) Applicant: SAMSUNG DISPLAY CO., LTD., Yongin-si, Gyeonggi-do (KR)

(72) Inventors: Myounggeun Cha, Seoul (KR); Sanggun Choi, Suwon-si (KR); Jiyeong Shin, Busan (KR); Yong Su Lee, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 16/381,491

(22) Filed: Apr. 11, 2019

(65) Prior Publication Data

US 2019/0340978 A1 Nov. 7, 2019

(30) Foreign Application Priority Data

May 2, 2018 (KR) ..... 10-2018-0050912

(51) Int. Cl.
*G09G 3/3233* (2016.01)

(52) U.S. Cl.
CPC ..... *G09G 3/3233* (2013.01); *G09G 2300/043* (2013.01); *G09G 2300/0426* (2013.01); *G09G 2300/0809* (2013.01); *G09G 2320/0214* (2013.01)

(58) Field of Classification Search
CPC ..... G09G 3/3233; G09G 2300/0426; G09G 2300/043; G09G 2300/0809; G09G 2300/019; G09G 2300/084; G09G 2300/0861; G09G 2320/0209; G09G 2320/0214; G09G 2330/041
See application file for complete search history.

(56) References Cited

U.S. PATENT DOCUMENTS

| | | | | |
|---|---|---|---|---|
| 9,660,090 | B2 | 5/2017 | Yoon | |
| 10,032,953 | B2 | 7/2018 | Jeon et al. | |
| 10,050,097 | B2 | 8/2018 | Oh et al. | |
| 2017/0365214 | A1* | 12/2017 | Tsai | G09G 3/3233 |

FOREIGN PATENT DOCUMENTS

| | | |
|---|---|---|
| JP | 2015-169811 | 9/2015 |
| KR | 10-2016-0087952 | 7/2016 |
| KR | 10-2017-0049705 | 5/2017 |

* cited by examiner

*Primary Examiner* — Mihir K Rayan
(74) *Attorney, Agent, or Firm* — F. Chau & Associates, LLC

(57) ABSTRACT

A pixel unit of a display device including: an OLED; a first transistor including a first electrode connected to a first node, a second electrode connected to a second node, and a third electrode connected to a third node; a capacitor including a first electrode receiving a power voltage and a second electrode connected to the first node; a second transistor including a first electrode receiving a scan signal, a second electrode receiving a data voltage and a third electrode connected to the second node; a third transistor including a first electrode receiving the scan signal, a second electrode connected to the first node and a third electrode connected to the third node, wherein at least one of the first and third transistors includes a fourth electrode, the fourth electrode receives a compensation voltage when an operation temperature is above a preset temperature and is floated when the operation temperature is equal to or more than the preset temperature.

20 Claims, 6 Drawing Sheets

PIXEL UNIT, A DISPLAY APPARATUS HAVING THE SAME AND A METHOD OF DRIVING THE DISPLAY APPARATUS

CROSS-REFERENCE TO RELATED APPLICATION

This application claims priority under 35 U.S.C. § 119 to Korean Patent Application No. 10-2018-0050912 filed on May 2, 2018, the disclosure of which is incorporated by reference herein in its entirety.

1. Technical Field

Exemplary embodiments of the inventive concept relate to a pixel unit, a display apparatus having the pixel unit and a method of driving the display apparatus.

2. Description of the Related Art

An organic light emitting display apparatus is widely used as a display device.

The organic light emitting display apparatus includes a plurality of pixels. Each of the pixels includes an organic light emitting diode and a pixel circuit for driving the organic light emitting diode. The organic light emitting diode is a light emitting diode in which the emissive electroluminescent layer is a film of an organic compound that emits light in response to an electric current. The pixel circuit includes a plurality of transistors and a plurality of capacitors.

When the organic light emitting display apparatus is operated for a long time, the operation temperature of the organic light emitting display apparatus increases. At this high temperature, a threshold voltage of at least one of the transistors is shifted toward a positive polarity. When the threshold voltage is shifted toward the positive polarity, a leakage current of the transistor is increased and a luminance of the organic light emitting display apparatus is decreased. Thus, a display defect such as a crosstalk may occur.

SUMMARY

According to an exemplary embodiment of the inventive concept, there is provided a pixel unit including an organic light emitting diode, a first transistor comprising a first electrode connected to a first node, a second electrode connected to a second node, and a third electrode connected to a third node, a capacitor comprising a first electrode which receives a first power voltage and a second electrode connected to the first node, a second transistor comprising a first electrode which receives a first scan signal, a second electrode which receives a data voltage and a third electrode connected to the second node, a third transistor comprising a first electrode which receives the first scan signal, a second electrode connected to the first node and a third electrode connected to the third node, and a sixth transistor comprising a first electrode which receives an emission control signal, a second electrode connected to the third node and a third electrode connected to an anode electrode of the organic light emitting diode, wherein at least one of the first and third transistors further comprises a fourth electrode, wherein the fourth electrode receives a compensation voltage when an operation temperature is equal to or more than a preset temperature and wherein the fourth electrode is floated when the operation temperature is less than the preset temperature.

According to an exemplary embodiment of the inventive concept, there is provided a display apparatus including a display part comprising a pixel unit. The pixel unit includes an organic light emitting diode, a first transistor comprising a first electrode connected to a first node, a second electrode connected to a second node, and a third electrode connected to a third node, a capacitor comprising a first electrode connected to a first voltage line and a second electrode connected to the first node, a second transistor comprising a first electrode connected to a first scan line, a second electrode connected to a data line and a third electrode connected to the second node, a third transistor comprising a first electrode connected to the first scan line, a second electrode connected to the first node and a third electrode connected to the third node, and a sixth transistor comprising a first electrode connected to an emission line, a second electrode connected to the third node and a third electrode connected to an anode electrode of the organic light emitting diode, wherein at least one of the first and third transistors further comprises a fourth electrode, the fourth electrode connected to a compensation line which transfers a compensation voltage, a temperature sensor configured to sense an operating temperature, a voltage generator configured to generate the compensation voltage, and a switching part configured to output the compensation voltage in response to a sensing signal indicating that the operating temperature is equal to or more than a preset temperature.

In an exemplary embodiment of the inventive concept, the display part may include a plurality of scan lines, a plurality of data lines, a plurality of emission lines, a plurality of compensation lines and a connection line, wherein the connection line is disposed in a peripheral area away from the display part and is connected to an output terminal of the switching part.

In an exemplary embodiment of the inventive concept, when the operating temperature is less than the preset temperature, the switching part may block an output of the compensation voltage for compensating a threshold voltage of the at least one transistor at a high temperature and the fourth electrode may be floated.

In an exemplary embodiment of the inventive concept, when the threshold voltage is shifted toward a positive polarity at the high temperature, a level of the compensation voltage may decrease, and when the threshold voltage is shifted toward a negative polarity at the high temperature, the level of the compensation voltage may increase.

In an exemplary embodiment of the inventive concept, the pixel unit may further include a fourth transistor including a first electrode connected to a second scan line, a second electrode connected to the first node and a third electrode connected to a second voltage line.

In an exemplary embodiment of the inventive concept, the pixel unit further includes a fifth transistor including a first electrode connected to an emission line, a second electrode connected to the first voltage line, and a third electrode connected to the second node.

In an exemplary embodiment of the inventive concept, the pixel unit further includes a seventh transistor including a first electrode connected to the first scan line, a second electrode connected to the second voltage line and a third electrode connected to the anode electrode of the organic light emitting diode.

In an exemplary embodiment of the inventive concept, the second scan line may be located next to the first scan line along a scan direction.

In an exemplary embodiment of the inventive concept, the display apparatus may further include a data driver configured to output a plurality of data voltages to the plurality of the data lines, a scan driver configured to output a plurality of scan signals to the plurality of scan lines, and an emission driver configured to output a plurality of emission control signals to the plurality of emission lines, wherein the data driver, the scan driver and the emission driver are disposed in the peripheral area away from the display part According to an exemplary embodiment of the inventive concept, there is provided a method of driving a display apparatus. The method may include turning on a first transistor of the display apparatus, wherein the first transistor has four independent terminals, applying a driving current corresponding to a data voltage to an organic light emitting diode of the display apparatus through the turned on first transistor, sensing an operation temperature of the display apparatus, and determining whether a compensation voltage is applied to at least one of a fourth electrode of the first transistor and a fourth electrode of the third transistor based on sensed operating temperature.

In an exemplary embodiment of the inventive concept, the method may further include turning on a third transistor of the display apparatus, wherein the third transistor has four independent terminals and compensating for the threshold voltage shift of the first transistor which is diode-connected by the turned on third transistor.

In an exemplary embodiment of the inventive concept, the method may further include floating at least one of the fourth electrode of the first transistor and the fourth electrode of the third transistor when the operation temperature is less than the preset temperature and applying a second compensation voltage for compensating for a threshold voltage shift to at least one of the fourth electrode of the first transistor and the fourth electrode of the third transistor when the operation temperature is equal to or more than the preset temperature.

In an exemplary embodiment of the inventive concept, when the threshold voltage is shifted toward a positive polarity at the high temperature, a level of the first compensation voltage may decrease, and when the threshold voltage is shifted toward a negative polarity at the high temperature, the level of the first compensation voltage may increase.

In an exemplary embodiment of the inventive concept, the method may further include turning on a seventh transistor of the display apparatus and applying an initial voltage to an anode electrode of an organic light emitting diode of the display apparatus through the turned on the seventh transistor.

In an exemplary embodiment of the inventive concept, the method may further include turning on a fourth transistor of a display apparatus and initializing a previous data voltage charged in a capacitor of the display apparatus into an initial voltage through the turned on fourth transistor.

According to an exemplary embodiment of the inventive concept, a pixel unit may include: an organic light emitting diode; a first transistor including a first electrode connected to a first node, a second electrode connected to a second node, and a third electrode connected to a third node; a capacitor including a first electrode connected to a first voltage line and a second electrode connected to the first node; a second transistor including a first electrode connected to a first scan line, a second electrode connected to a data line and a third electrode connected to the second node; a third transistor including a first electrode connected to the first scan line, a second electrode connected to the first node and a third electrode connected to the third node; and a sixth transistor including a first electrode connected to an emission line, a second electrode connected to the third node and a third electrode connected to the organic light emitting diode, wherein at least one of the first and third transistors further including a fourth electrode, wherein the fourth electrode is connected to a compensation line through which a compensation voltage is provided under a preset condition based on a temperature.

In an exemplary embodiment of the inventive concept, the compensation voltage is provided to the fourth electrode of the first transistor when an operating temperature of the first transistor exceeds a predetermined temperature.

In an exemplary embodiment of the inventive concept, the compensation voltage is provided to the fourth electrode of the third transistor when an operating temperature of the third transistor exceeds a predetermined temperature.

In an exemplary embodiment of the inventive concept, the pixel unit may further include a fourth transistor including a first electrode connected to a second scan line, a second electrode connected to the first node and a third electrode connected to a second voltage line; a fifth transistor including a first electrode connected to the emission line, a second electrode connected to the first voltage line and a third electrode connected to the second node; and a seventh transistor including a first electrode connected to the first scan line, a second electrode connected to the second voltage line and a third electrode connected to the organic light emitting diode.

BRIEF DESCRIPTION OF THE DRAWINGS

The above and other features of the inventive concept will become more apparent by describing in detail exemplary embodiments thereof with reference to the accompanying drawings, in which.

DETAILED DESCRIPTION OF THE EMBODIMENTS

Hereinafter, exemplary embodiments of the inventive concept will be explained in detail with reference to the accompanying drawings.

Figure 1:
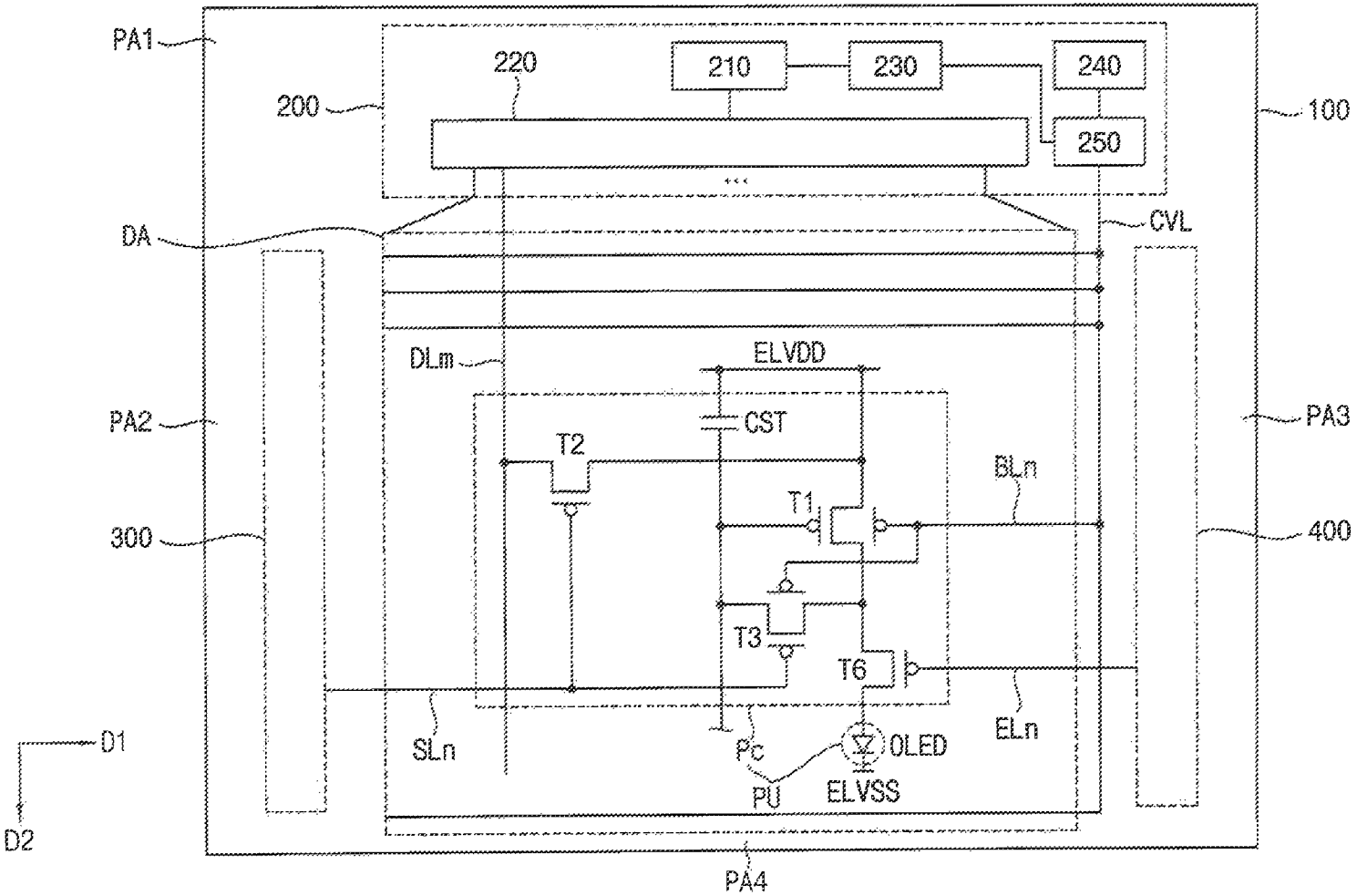
FIG. 1 is a block diagram illustrating a display apparatus according to an exemplary embodiment.

FIG. 1 is a block diagram illustrating a display apparatus according to an exemplary embodiment of the inventive concept.

Referring to FIG. 1, the display apparatus may include a panel part 100, a main driver 200, a scan driver 300 and an emission driver 400.

The panel part 100 may include a display part DA and a peripheral part surrounding the display part DA. The peripheral part may include a plurality of peripheral areas PA1, PA2, PA3 and PA4.

The display part DA may include a plurality of pixel units PU, a plurality of scan lines SLn, a plurality of data lines DLm, a plurality of emission lines ELn and a plurality of compensation lines BLn ('n' and 'm' are natural numbers).

Each of the plurality of pixel units PU may include an organic light emitting diode OLED and a pixel circuit Pc for driving the organic light emitting diode OLED.

The pixel circuit Pc may include a first transistor T1, a second transistor T2, a third transistor T3, a storage capacitor CST and a sixth transistor T6.

The first transistor T1 includes a first electrode connected to a first electrode of the storage capacitor CST, a second electrode for receiving a high power voltage ELVDD, a third electrode connected to an anode of the organic light emitting diode OLED and a fourth electrode connected to a compensation line BLn. A threshold voltage of the first transistor T1 is shifted when the first transistor T1 drives in a high temperature. The compensation line BLn may transfer a compensation voltage for compensating the shifted threshold voltage of the first transistor T1. The second transistor T2 includes a first electrode connected to a scan line SLn, a second electrode connected to a data line DLm and a third electrode for receiving the high power voltage ELVDD.

The third transistor T3 includes a first electrode connected to the scan line SLn, a second electrode connected to the first electrode of the storage capacitor CST, a third electrode connected between the third electrode the first transistor T1 and the anode electrode of the organic light emitting diode OLED and a fourth electrode connected to the compensation line BLn. A threshold voltage of the third transistor 13 is shifted when the third transistor T3 drives in a high temperature. The compensation line BLn may transfer a compensation voltage for compensating the shifted threshold voltage of the third transistor T3.

The sixth transistor T6 include a first electrode connected to the emission line ELn, a second electrode connected to the third electrode of the first transistor T1 and a third electrode connected to the anode electrode of the organic light emitting diode OLED.

The plurality of scan lines SLn may be extended in a first direction D1 and be arranged in a second direction D2 crossing the first direction D1. The plurality of scan lines SLn is connected to the scan driver 300 and transfers a scan signal generated from the scan driver 300.

The plurality of data lines DLm may be extended in the second direction D2 and be arranged in the first direction D1. The plurality of data lines DLm is connected to the data driver 220 and transfers a data signal generated from the data driver 220.

The plurality of emission lines ELn may be extended in the first direction D1 and be arranged in the second direction D2. The plurality of emission lines ELn is connected to the emission driver 400 and transfers an emission control signal generated from the emission driver 400. The plurality of compensation lines BLn may be extended in the first direction D1 and be arranged in the second direction D2. The plurality of compensation lines BLn may be commonly connected to a connection line CVL which is extended in first direction D1 in the peripheral part. The connection line CVL is connected to the main driver 200.

The peripheral part includes a first peripheral area PA1, a second peripheral area PA2, a third peripheral area PA3 and a fourth peripheral area PA4. The first, second, third and fourth peripheral areas PA1, PA2, PA3 and PA4 may be adjacent to one of four sides of the display part DA, respectively.

The main driver 200 is disposed in the first peripheral area PA1 and controls a general operation of the display apparatus.

The main driver 200 may include a timing controller 210, a data driver 220, a voltage generator 230, a temperature sensor 240 and a switching part 250.

The timing controller 210 may receive an image signal and a control signal from an external device. The image signal may include red, green and blue data. The control signal may include a horizontal synchronization signal, a vertical synchronization signal, a main clock signal, etc.

The timing controller 210 may convert the image signal to image data corresponding to a pixel structure and a resolution of the display part DA.

The timing controller 210 may generate a first control signal for driving the data driver 220, a second control signal for driving the scan driver 300 and a third control signal for driving the emission driver 400 based on the control signal provided from the external device. The data driver 220 converts the image data to a data voltage and outputs the data voltage to the data line DLm in response to the first control signal.

The voltage generator 230 may generate a plurality of driving voltages. The plurality of driving voltages includes a first driving voltage applied to the display part DA, a second driving voltage applied to the data driver 220, a third driving voltage applied to the scan driver 300, a fourth driving voltage applied to the emission driver 400 and a fifth driving voltage applied to the switching part 250.

The first driving voltage may include a high power voltage ELVDD and a low power voltage ELVSS, the second driving voltage may include a digital power voltage and an analog power voltage, the third driving voltage may include a scan on voltage and a scan off voltage, the fourth driving voltage may include an emission on voltage and an emission off voltage and the fifth driving voltage may include a compensation voltage. When, for example, at least one of the transistors T1 and T3 is operated in the high temperature, a threshold voltage of the transistor is shifted. The compensation voltage compensates a shifted threshold voltage into a best threshold voltage at the high temperature.

The temperature sensor 240 is configured to sense an operation temperature of the display apparatus, and output a sensing signal corresponding to the operation temperature. For example, the temperature sensor 240 is configured to output a first sensing signal when the operation temperature of the display apparatus is equal to or more than a preset temperature, and to output a second sensing signal when the operation temperature is less than the preset temperature.

For example, the preset temperature may be about 60° C. The temperature sensor 240 is configured to output a first sensing signal when the operation temperature is equal to or more than about 60° C. and to output a second sensing signal when the operation temperature is less than about 60° C.

The switching part 250 receives a sensing signal from the temperature sensor 240. The switching part 250 determines whether the compensation voltage generated by the voltage generator 230 is applied to the connection line CVL in response to the sensing signal. For example, the switching part 250 switches an output of the compensation voltage generated by the voltage generator 230 in response to the sensing signal. An output terminal of the switching part 250 is connected to the connection line CVL.

When the switching part 250 is turned on in response to the sensing signal, the switching part 250 outputs the compensation voltage to the connection line CVL. When the switching part 250 is turned off in response to the sensing signal, the switching part 250 blocks the compensation voltage from being outputted to the connection line CVL.

For example, when the switching part 250 receives the first sensing signal indicative of the operation temperature being more than the preset temperature, the switching part 250 outputs the compensation voltage to the connection line CVL. Thus, the compensation voltage may be applied to a plurality of compensation lines BLn in the display part DA through the connection line CVL. When the switching part 250 receives the second sensing signal indicative of the operation temperature being less than the preset temperature, the switching part 250 blocks the compensation voltage from being outputted to the connection line CVL. Thus, the compensation voltage is not applied to the connection line CVL and the plurality of compensation lines BLn.

The scan driver 300 is disposed in the second peripheral area PA2, and is connected to the plurality of scan lines SLn. The scan driver 300 generates a plurality of scan signals in response to the second control signal and outputs the plurality of scan signals to the plurality of scan lines SLn.

The emission driver 400 is disposed in the third peripheral area PA3 and is connected to the plurality of emission lines ELn. The emission driver 400 generates a plurality of emission control signals in response to the third control signal, and outputs the plurality of emission control signals to the plurality of emission lines ELn.

According to the present exemplary embodiment, when the display apparatus is operated in the high temperature above the preset temperature, the compensation voltage is applied to at least one of the transistors T1 and T3 in the pixel circuit Pc to compensate the shifted threshold voltage of the at least one transistor. Thus, the shifted threshold voltage may be compensated into a best threshold voltage without changing conditions of manufacturing processes. Thus, a leakage current of the at least one transistor by the shifted threshold voltage is reduce or eliminated and display quality of the display apparatus is increased.

Figure 2:
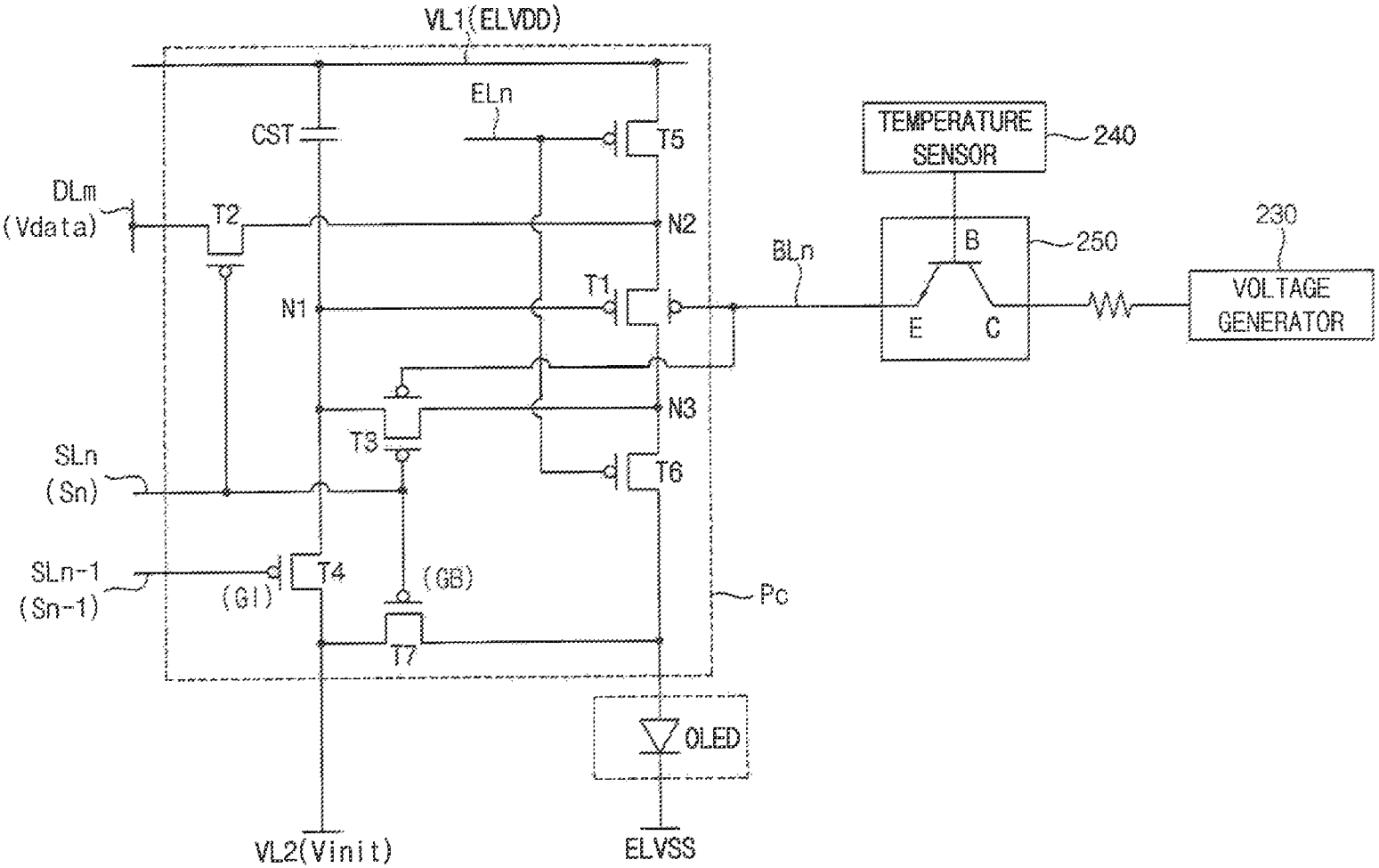
FIG. 2 is a circuit diagram illustrating a display apparatus according to an exemplary embodiment.
Figure 3:
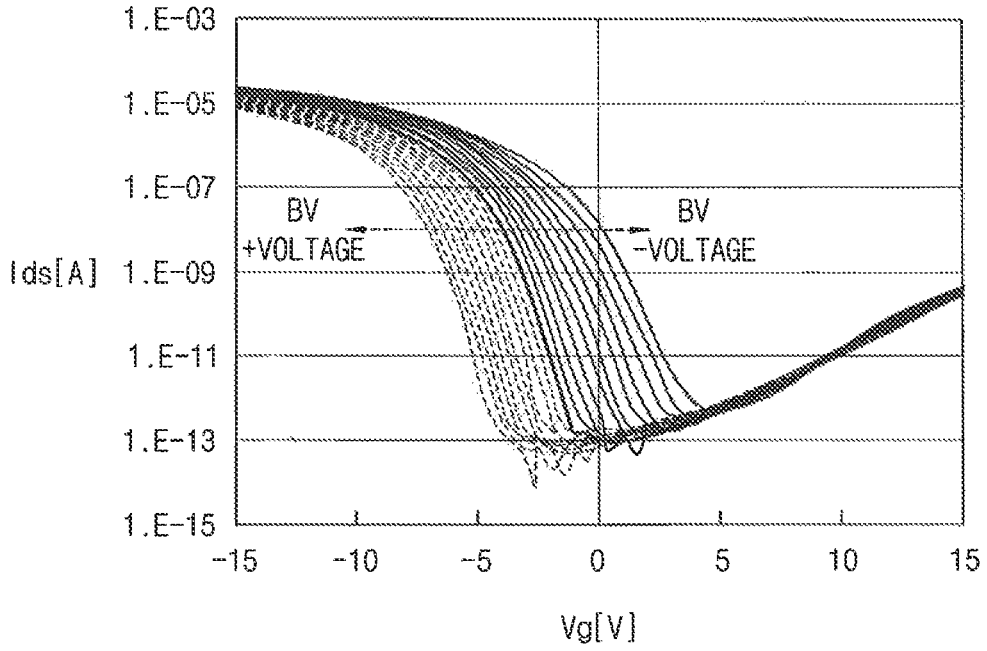
FIG. 3 is a graph diagram illustrating an I-V characteristic of an independent four-terminal transistor according to an exemplary embodiment.

FIG. 2 is a circuit diagram illustrating a display apparatus according to an exemplary embodiment of the inventive concept. FIG. 3 is a graph diagram illustrating an I-V characteristic of an independent four-terminal transistor according to an exemplary embodiment of the inventive concept.

In FIG. 3, the vertical axis may correspond to current Ids of the independent four-terminal transistor, and this horizontal axis may correspond to voltage Vg of the independent four-terminal transistor.

Referring to FIGS. 1 and 2, the display apparatus may include an organic light emitting diode OLED, a pixel circuit Pc, a voltage generator 230, a temperature sensor 240 and a switching part 250.

The organic light emitting diode OLED is connected to the pixel circuit Pc and configured to emit a light corresponding to a grayscale.

The pixel circuit Pc may include a first transistor T1, a capacitor CST, a second transistor T2, a third transistor T3, a fourth transistor T4, a fifth transistor T5, a sixth transistor T6 and a seventh transistor 17.

According to the present exemplary embodiment, each of the transistors T1 to T7 is a P-type transistor which is turned on in response to a low voltage applied to a control electrode of the transistor and is turned off in response to a high voltage applied to the control electrode of the transistor. Alternatively, each of the transistors T1 to T7 may be an N-type transistor which is turned on in response to a high voltage applied to a control electrode of the transistor and is turned off in response to a low voltage applied to the control electrode of the transistor.

According to the present exemplary embodiment, the pixel circuit Pc may include a data line DLm, an n-th scan line SLn, an (n−1)-th scan line SLn−1, an emission line ELn and a compensation line BLn.

The first transistor T1 includes a first electrode connected to a first node N1, a second electrode connected to a second node N2, a third electrode connected to a third node N3 and a fourth electrode connected to the compensation line BLn.

When the operation temperature of the display apparatus is equal to or more than a preset temperature, the fourth electrode of the first transistor T1 receives a compensation voltage through the compensation line BLn. The threshold voltage of the first transistor T1 may be compensated to the best threshold voltage for the high temperature.

When the operation temperature of the display apparatus is less than the preset temperature, the compensation voltage is blocked from being applied to the compensation line BLn. Thus, the fourth electrode of the first transistor T1 is floated.

The capacitor CST includes a first electrode connected to a first voltage line VL1 and a second electrode connected to the first node N1. The first voltage line VL1 receives a high power voltage ELVDD.

The second transistor T2 includes a first electrode for receiving a first scan signal Sn, a second electrode connected to the data line DLm and a third electrode connected to the second node N2. The data line DLm transfers a data voltage Vdata to the pixel circuit Pc. The first scan signal Sn is generated from the scan driver 300 and the first electrode of the second transistor T2 may be connected to the n-th scan line SLn. The first scan signal Sn includes a scan on voltage for turning on the second transistor T2 and a scan off voltage for turning off the second transistor T2.

The third transistor T3 includes a first electrode for receiving the first scan signal Sn, a second electrode connected to the first node N1, a third electrode connected to the third node N3 and a fourth electrode connected to the compensation line BLn. The first electrode of the third transistor T3 may be connected to the n-th scan line SLn.

When the operation temperature of the display apparatus is equal to or more than the preset temperature, the fourth electrode of the third transistor T3 may receive the compensation voltage through the compensation line BLn. The threshold voltage of the third transistor T3 may be compensated to the best threshold voltage for the high temperature.

When the operation temperature of the display apparatus is less than the preset temperature, the compensation voltage is blocked from being applied to the compensation line BLn. Thus, the fourth electrode of the third transistor T3 is floated.

The fourth transistor T4 includes a first electrode for receiving a first gate signal GI, a second electrode connected to the first node N1 and a third electrode connected to a second voltage line VL2. The first gate signal GI may be a second scan signal Sn−1 which is generated by the scan driver 300. The scan driver 300 may transfer the second scan signal Sn−1 through the (n−1)-th scan line SLn−1.

The (n−1)-th scan line SLn−1 transfers the second scan signal Sn−1 and the second voltage line VL2 receives an initial voltage Vinit.

The fifth transistor T5 includes a first electrode connected to the emission line ELn, a second electrode connected to the first voltage line VL1 and a third electrode connected to the second node N2. The emission line ELn receives an n-th emission control signal generated by the emission driver 400. The n-th emission control signal may include an emission on voltage for turning on the fifth transistor T5 and an emission off voltage for turning off the fifth transistor T5.

The sixth transistor T6 includes a first electrode connected to the emission line ELn, a second electrode connected to the third node N3, and a third electrode connected to an anode electrode of the organic light emitting diode OLED. The emission line ELn receives the n-th emission control signal generated by the emission driver 400.

The seventh transistor T7 includes a first electrode for receiving a second gate signal GB, a second electrode connected to the second voltage line VL2 and a third electrode connected to the anode electrode of the organic light emitting diode OLED. The second gate signal GB may be the first scan signal Sn and may be applied to the n-th scan line SLn.

The voltage generator 230 generates a compensation voltage BV. The compensation voltage BV may have a voltage level for compensating a shifted threshold voltage of a particular transistor shifted due to the high temperature.

Table 1 shows a threshold voltage Vth_sat according to a compensation voltage BV applied to a fourth electrode of an independent four-terminal transistor.

TABLE 1

| | INDEPENDENT Four-terminal Transistor | | | | | | | | |
|---|---|---|---|---|---|---|---|---|---|
| BV (V) | 0 | 1 | 2 | 3 | 4 | 5 | 6 | 7 | 8 |
| Vth_sat(V) | −3.26 | −3.58 | −3.91 | −4.22 | −4.53 | −4.84 | −5.16 | −5.47 | −5.77 |

Referring to Table 1, the threshold voltage Vth_sat is shifted by about 0.3 V per about 1 V of the compensation voltage BV applied to the fourth electrode of the independent four-terminal transistor.

For example, at 60° C., the threshold voltage of the independent four-terminal transistor is shifted about 0.5 V toward a positive polarity from a standard. The standard may refer to an original or ideal threshold voltage of the independent four-terminal transistor. In order to compensate the shifted threshold voltage, the shifted threshold voltage may be shifted about 0.5 V toward a negative polarity.

Referring to FIG. 3, when the compensation voltage BV applied to the fourth electrode of the independent four-terminal transistor is increased, the threshold voltage Vth is shifted toward the negative polarity. When the compensation voltage BV applied to the fourth electrode of the independent four-terminal transistor is decreased, the threshold voltage Vth is shifted toward the positive polarity.

Therefore, referring to Table 1, a compensation voltage BV about 1 V to about 2 V higher than a reference voltage is applied to the fourth electrode of the independent four-terminal transistor. The threshold voltage shifted by about 0.5 V toward the positive polarity may be shifted by about 0.5 V toward the negative polarity, and thus, the threshold voltage is compensated.

As described above, the voltage generator 230 is configured to generate the compensation voltage BV having a predetermined level.

The temperature sensor 240 is configured to sense an operation temperature of the display apparatus, and output a sensing signal corresponding to the operation temperature. For example, the temperature sensor 240 may output a first sensing signal when the operation temperature is equal to or more than about 60° C., which is a preset temperature, and a second sensing signal when the operation temperature is less than about 60° C. which is the preset temperature.

The switching part 250 receives the sensing signal from the temperature sensor 240 and switches an output of the compensation voltage BV generated by the voltage generator 230 in response to the sensing signal. For example, the switching part 250 is turned on in response to the sensing signal corresponding to the operation temperature being more than about 60° C., which is the preset temperature, and the switching part 250 is turned off in response to the sensing signal corresponding to the operation temperature being less than about 60° C. which is the preset temperature.

When the switching part 250 is turned on, the compensation voltage BV generated by the voltage generator 240 is applied to a plurality of compensation lines BLn in the display part DA through a connection line CVL in the peripheral area. Thus, when the operation temperature of the display apparatus is the high temperature, the threshold voltages of first and third transistors T1 and T3 in the pixel circuit Pc may be compensated by the compensation voltage.

When the switching part 250 is turned off, the switching part 250 blocks the compensation voltage BV generated by the voltage generator 240 from being outputted to the connection line CVL. Thus, when the operation temperature of the display apparatus is a normal temperature, the fourth electrodes of the first and third transistors T1 and T3 in the pixel circuit Pc are floated.

The switching part 250 may be a transistor including a base B, an emitter E and a collector C. A resistor may be disposed between the switching part 250 and the voltage generator 230.

Figure 4:
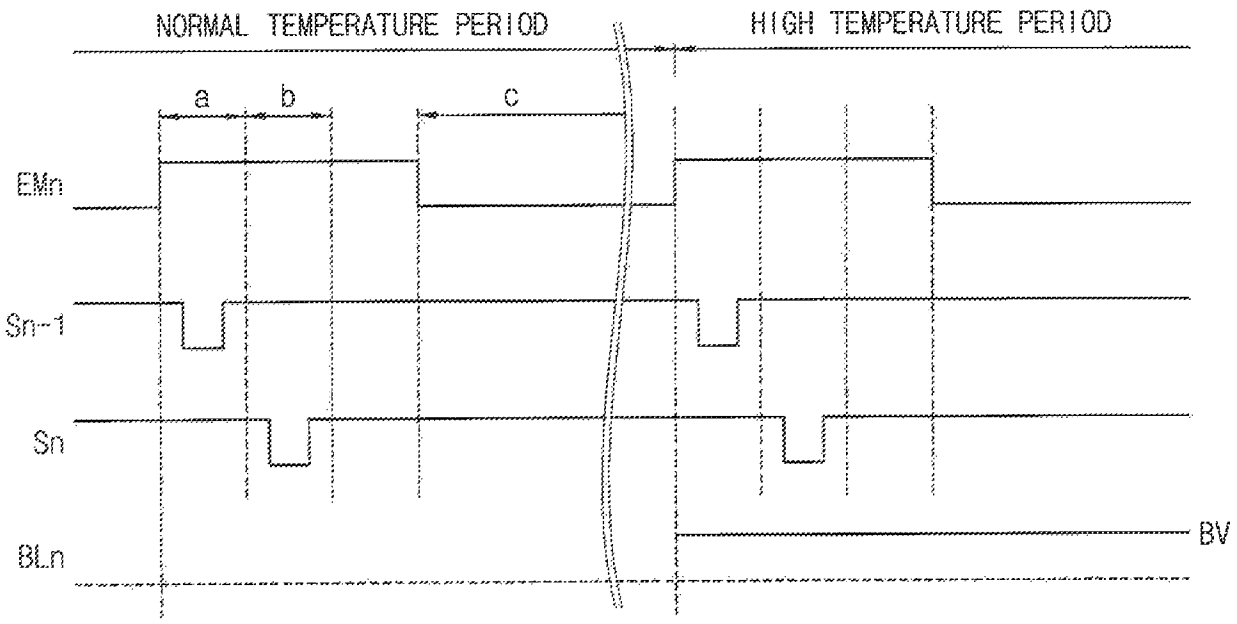
FIG. 4 is a waveform diagram illustrating a method of driving a display apparatus according to an exemplary embodiment.

FIG. 4 is a waveform diagram illustrating a method of driving a display apparatus according to an exemplary embodiment of the inventive concept. The first half of FIG. 4 corresponds to a normal temperature period and the second half of FIG. 4 corresponds to a high temperature period.

Referring to FIGS. 2 and 4, the temperature sensor 240 is configured to sense an operation temperature of the display apparatus, and output a sensing signal corresponding to the operation temperature to the switching part 250.

When the sensing signal corresponds to a normal temperature that is less than the preset temperature, the switching part 250 is turned off in response to the sensing signal.

When the switching part 250 is turned off, the switching part 250 blocks an output of the compensation voltage BV generated by the voltage generator 230. Thus, the compensation voltage BV is not applied to the fourth electrodes of the first and third transistors T1 and T3 in the pixel circuit Pc which are connected to the compensation line BLn. In other words, the compensation voltage BV is not applied during the normal temperature period.

When the display apparatus is operated for a long time, the operation temperature of the display apparatus may increase and become higher than the preset temperature. Thus, the temperature sensor 230 outputs a sensing signal indicating that the operation temperature is higher than the preset temperature.

The switching part 250 is turned on in response to the sensing signal corresponding to the high temperature. When the switching part 250 is turned on, the compensation voltage BV generated by the voltage generator 230 is applied to the connection line CVL. In other words, the compensation voltage BV is applied during the high temperature period.

Thus, the compensation voltage BV is applied to the fourth electrodes of the first and third transistors T1 and T3 in the pixel circuit Pc which are connected to the compensation line BLn.

The first and third transistors T1 and T3 in the pixel circuit Pc may be compensated by the compensation voltage BV, and thus, have the best threshold voltage at the high temperature.

Hereinafter, a method of driving the pixel circuit Pc is explained.

During a first period 'a' of a frame, the fourth transistor T4 is turned on in response to a low voltage of an (n−1)-th scan signal Sn−1 applied to a second scan line SLn−1, and the transistors T1, T2, T3, T5, T6 and T7 are turned off. Thus, a previous data voltage charged in the capacitor CST is initialized to the initial voltage Vinit applied to the second voltage line VL2.

During a second period 'b' of the frame, the second transistor T2, the third transistor T3, and the seventh transistor T7 are turned on in response to a low voltage of an n-th scan signal Sn applied to a first scan line SLn, and the transistors T1, T5 and T6 are turned off.

Thus, the third transistor T3 is turned on and the first transistor T1 is diode-connected by the third transistor T3. The second node N2 receives a data voltage Vdata applied to the data line DLm. The first node N1 receives a difference voltage between the data voltage Vdata of the second node N2 and the threshold voltage of the first transistor T1. The difference voltage between the data voltage Vdata of the second node N2 and the threshold voltage is applied to the first node N1, and thus, the threshold voltage of the first transistor T1 may be compensated.

In addition, the capacitor CST charges a voltage corresponding to the data voltage Vdata.

In addition, the seventh transistor T7 is turned on and the initial voltage Vinit is applied to an anode electrode of the organic light emitting diode OLED. Thus, the anode electrode of the organic light emitting diode OLED is initialized into the initial voltage Vinit.

As described above, during the second period 'b' of the frame, the threshold voltage of the first transistor T1 may be compensated, the data voltage Vdata may be charged in the capacitor CST, and the anode electrode of the organic light emitting diode OLED may be initialized.

During a third period 'c' of the frame, a low level of an n-th emission on voltage EMn is applied to an emission line ELn, and the fifth and sixth transistors T5 and T6 are turned on. In addition, the transistors T1, T2, T3, T4 and T7 are turned off.

Thus, the first transistor T1 is turned on by the data voltage Vdata charged in the capacitor CST, and a driving current corresponding to the data voltage Vdata is applied to the organic light emitting diode OLED. Therefore, the organic light emitting diode OLED emits a light corresponding to an image.

According to the present exemplary embodiment, the first transistor T1 controlling a luminance of the light and the third transistor T3 diode-connecting the first transistor T! in the pixel circuit Pc are designed as an independent four-terminal transistor. In the high temperature, the compensation voltage BV is applied to the fourth electrodes of the first and third transistors T1 and T3, and thus, the first and third transistors T1 and T3 are compensated to have the best threshold voltage in the high temperature state. Therefore, a display defect such as crosstalk, which occurs due to the shifted threshold voltage in the high temperature state, may be avoided.

Figure 5:
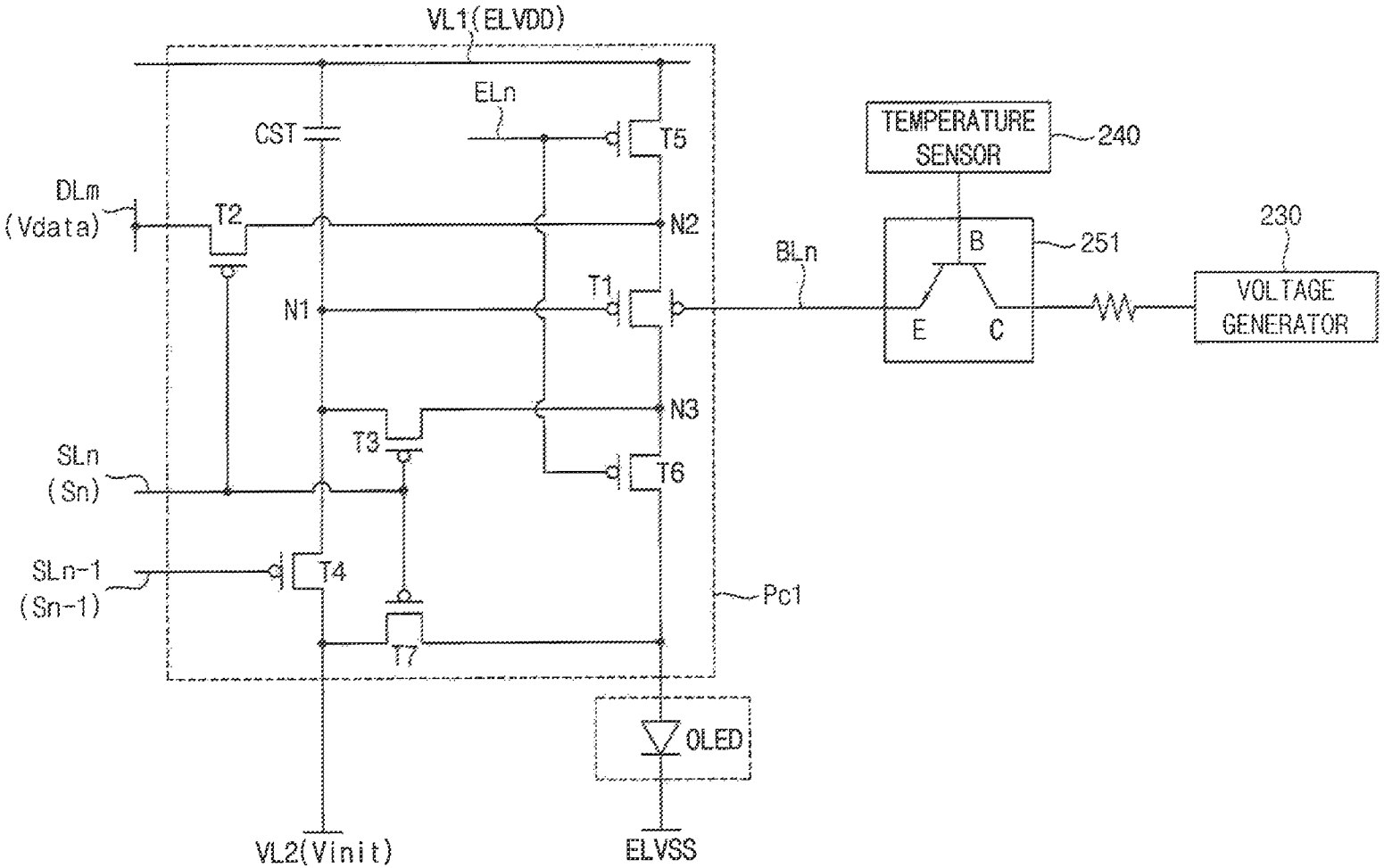
FIG. 5 is a circuit diagram illustrating a display apparatus according to an exemplary embodiment.

FIG. 5 is a circuit diagram illustrating a display apparatus according to an exemplary embodiment of the inventive concept.

Referring to FIG. 5, the display apparatus may include an organic light emitting diode OLED, a pixel circuit Pc1, a voltage generator 230, a temperature sensor 240 and a switching part 251.

According to the present exemplary embodiment, the pixel circuit Pc1 may include a first transistor T1, a capacitor CST, a second transistor T2, a third transistor T3, a fourth transistor T4, a fifth transistor T5, a sixth transistor T6 and a seventh transistor T7.

In the pixel circuit Pc1, the first transistor T1 includes a first electrode connected to a first node N1, a second electrode connected to a second node N2, a third electrode connected to a third node N3 and a fourth electrode connected to a compensation line BLn. The third transistor T3 includes a first electrode connected to the scan line SLn a second electrode connected to a first electrode of the storage capacitor CST and a third electrode connected between the third electrode the first transistor T1 and the sixth transistor T6. For example, the third electrode of the third transistor T3 is connected to the third node N3.

The switching part 251 is connected to the fourth electrode of the first transistor T1. The switching part 251 may be a transistor including a base B, an emitter E and a collector C. A resistor may be disposed between the switching part 251 and the voltage generator 230.

According to the present exemplary embodiment, the switching part 251 is turned on or off in response to a sensing signal received from the temperature sensor 240 and switches an output of the compensation voltage BV. For example, when the sensing signal indicates that an operation temperature of the display apparatus is equal to or more than a preset temperature (for example, 60° C.), the switching part 251 is turned on. When the sensing signal indicates that an operation temperature of the display apparatus is less than a preset temperature (for example, 60° C.), the switching part 251 is turned off.

When the switching part 251 is turned on, the switching part 251 outputs the compensation voltage BV generated by the voltage generator 240 to the connection line CVL in the peripheral area. Thus, the compensation voltage BV is applied to a plurality of compensation lines BLn in the display part DA through the connection line CVL. Therefore, when the display apparatus is operated in the high temperature, a shifted threshold voltage of the first transistor T1 is compensated by the compensation voltage BV.

When the switching part 251 is turned off, the switching part 251 blocks the compensation voltage BV from being applied to the plurality of compensation lines BLn. Thus, when the display apparatus is operated in a normal temperature, the fourth electrode of the first transistor T1 is floated.

According to the present exemplary embodiment, the first transistor T1 for controlling a luminance of the light is an independent four-terminal transistor. In the high temperature, the compensation voltage is applied to the fourth electrode of the first transistor T1, and thus, the first transistor T1 is compensated to have the best threshold voltage in the high temperature. Therefore, a display defect such as crosstalk, which occurs due to the shifted threshold voltage in the high temperature, may be avoided.

Figure 6:
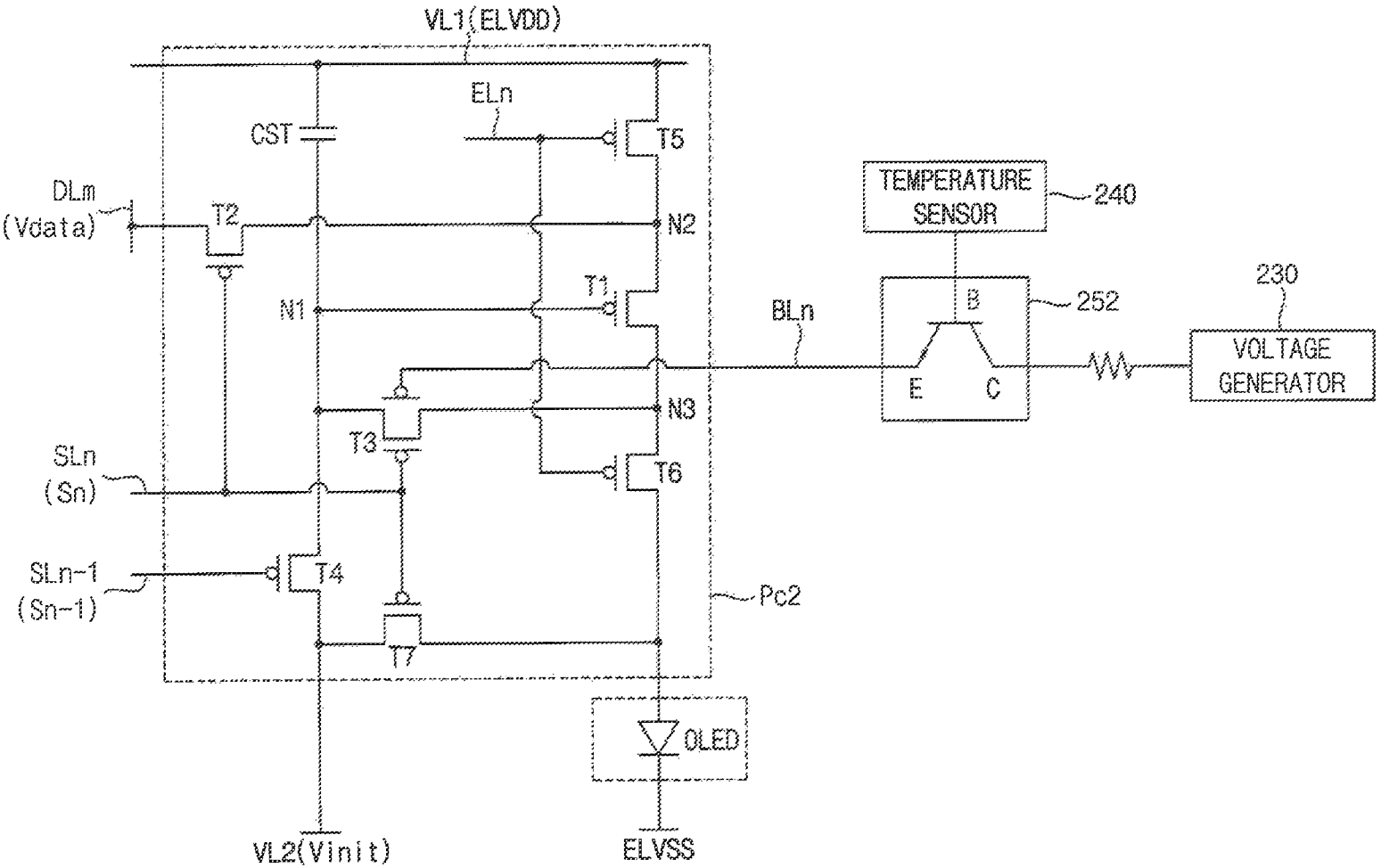
FIG. 6 is a circuit diagram illustrating a display apparatus according to an exemplary embodiment of the inventive concept.

FIG. 6 is a circuit diagram illustrating a display apparatus according to an exemplary embodiment of the inventive concept.

Referring to FIG. 6, the display apparatus may include an organic light emitting diode OLED, a pixel circuit Pc2, a voltage generator 230, a temperature sensor 240 and a switching part 252.

According to the present exemplary embodiment, the pixel circuit Pc2 may include a first transistor T1, a capacitor CST, a second transistor T2, a third transistor T3, a fourth transistor T4, a fifth transistor T5, a sixth transistor T6 and a seventh transistor T7.

In the pixel circuit Pc2, the first transistor T1 includes a first electrode connected to a first node N1, a second electrode connected to a second node N2 and a third electrode connected to a third node N3. The third transistor T3 includes a first electrode connected to the scan line SLn, a second electrode connected to a first electrode of the storage capacitor CST, a third electrode connected between the third electrode the first transistor T1 and the sixth transistor T6 and a fourth electrode connected to the compensation line BLn.

The switching part 252 is connected to the fourth electrode of the third transistor T3. The switching part 252 may be a transistor including a base B, an emitter E and a collector C. A resistor may be disposed between the switching part 252 and the voltage generator 230.

According to the present exemplary embodiment, the switching part 252 is turned on or off in response to a sensing signal received from the temperature sensor 240 and switches an output of the compensation voltage BV. For example, when the sensing signal indicates an operation temperature of the display apparatus is equal to or more than a preset temperature (for example, 60° C.), the switching part 252 is turned on. When the sensing signal indicates an operation temperature of the display apparatus is less than a preset temperature (for example, 60° C.), the switching part 252 is turned off.

When the switching part 252 is turned on, the switching part 252 outputs the compensation voltage BV generated by the voltage generator 240 to the connection line CVL in the peripheral area. Thus, the compensation voltage BV is applied to a plurality of compensation lines BLn in the display part DA through the connection line CVL. Therefore, when the display apparatus is operated in the high temperature environment, a shifted threshold voltage of the third transistor T3 is compensated by the compensation voltage BV.

However, when the switching part 252 is turned off, the switching part 252 blocks the compensation voltage BV from being applied to the plurality of compensation lines BLn. Thus, when the display apparatus is operated in a normal temperature environment, the fourth electrode of the third transistor T3 is floated.

According to the present exemplary embodiment, the third transistor T3, which diode-connects the first transistor T1, is an independent four-terminal transistor. At high temperatures, the compensation voltage BV is applied to the fourth electrode of the third transistor T3, and thus, the third transistor T3 is compensated into a best threshold voltage for the high temperature. Therefore, a display defect such as crosstalk due to the shifted threshold voltage in the high temperature may be avoided.

According to the exemplary embodiments of the inventive concept, the pixel circuit (e.g., Pc, Pc1 or Pc2) may include at least one independent four-terminal transistor for compensating the threshold voltage of the independent four-terminal transistor in the high temperature state. A compensation voltage BV may be applied to a fourth electrode of the independent four-terminal transistor, and thus, the threshold voltage of the independent four-terminal transistor may be compensated in the high temperature state. Therefore, a display defect such as crosstalk due to the shifted threshold voltage in the high temperature state may be avoided. In addition, the shifted threshold voltage may be compensated into a best threshold voltage without changing conditions of doping processes. Thus, a leakage current of the transistor due to the shifted threshold voltage is removed and the display quality may be increased.

The present inventive concept may be applied to a display device and an electronic device having the display device. For example, the present inventive concept may be applied to a computer monitor, a laptop, a digital camera, a cellular phone, a smart phone, a smart pad, a television, a personal digital assistant (PDA), a portable multimedia player (PMP), an MP3 player, a navigation system, a game console, a video phone, etc.

While the inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A pixel unit of a display device, comprising:

an organic light emitting diode;

a first transistor comprising a first electrode connected to a first node, a second electrode connected to a second node, and a third electrode connected to a third node;

a capacitor comprising a first electrode which receives a first power voltage and a second electrode connected to the first node;

a second transistor comprising a first electrode which receives a first scan signal, a second electrode which receives a data voltage and a third electrode connected to the second node;

a third transistor comprising a first electrode which receives the first scan signal, a second electrode connected to the first node and a third electrode connected to the third node; and a sixth transistor comprising a first electrode which receives an emission control signal, a second electrode connected to the third node and a third electrode connected to an anode electrode of the organic light emitting diode, wherein at least one of the first and third transistors further comprises a fourth electrode, wherein the fourth electrode receives a compensation voltage when an operation temperature is equal to or more than a preset temperature provided from the display device and wherein the fourth electrode is floated when the operation temperature is less than the preset temperature.

2. A display apparatus, comprising:

a display part comprising a pixel unit, the pixel unit comprising:

an organic light emitting diode;

a first transistor comprising a first electrode connected to a first node, a second electrode connected to a second node, and a third electrode connected to a third node;

a capacitor comprising a first electrode connected to a first voltage line and a second electrode connected to the first node;

a second transistor comprising a first electrode connected to a first scan line, a second electrode connected to a data line and a third electrode connected to the second node;

a third transistor comprising a first electrode connected to the first scan line, a second electrode connected to the first node and a third electrode connected to the third node; and a sixth transistor comprising a first electrode connected to an emission line, a second electrode connected to the third node and a third electrode connected to an anode electrode of the organic light emitting diode, wherein at least one of the first and third transistors further comprises a fourth electrode, the fourth electrode connected to a compensation line which transfers a compensation voltage, a temperature sensor configured to sense an operating temperature;

a voltage generator configured to generate the compensation voltage; and a switching part configured to output the compensation voltage in response to a sensing signal indicating that the operating temperature is equal to or more than a preset temperature.

3. The display apparatus of claim 2, wherein the display part comprises a plurality of scan lines, a plurality of data lines, a plurality of emission lines, a plurality of compensation lines and a connection line, wherein the connection line is disposed in a peripheral area away from the display part and is connected to an output terminal of the switching part.

4. The display apparatus of claim 2, wherein when the operating temperature is less than the preset temperature, the switching part blocks an output of the compensation voltage for compensating a threshold voltage of the at least one transistor at a high temperature and the fourth electrode is floated.

5. The display apparatus of claim 2, wherein when the threshold voltage is shifted toward a positive polarity at the high temperature, a level of the compensation voltage decreases, and when the threshold voltage is shifted toward a negative polarity at the high temperature, the level of the compensation voltage increases.

6. The display apparatus of claim 2, wherein the pixel unit further comprises a fourth transistor comprising a first electrode connected to a second scan line, a second electrode connected to the first node and a third electrode connected to a second voltage line.

7. The display apparatus of claim 6, wherein the pixel unit further comprises a fifth transistor comprising a first electrode connected to an emission line, a second electrode connected to the first voltage line, and a third electrode connected to the second node.

8. The display apparatus of claim 7, wherein the pixel unit further comprises a seventh transistor comprising a first electrode connected to the first scan line, a second electrode connected to the second voltage line and a third electrode connected to the anode electrode of the organic light emitting diode.

9. The display apparatus of claim 8, wherein the second scan line is located next to the first scan line along a scan direction.

10. The display apparatus of claim 3, further comprising:

a data driver configured to output a plurality of data voltages to the plurality of the data lines;

a scan driver configured to output a plurality of scan signals to the plurality of scan lines; and an emission driver configured to output a plurality of emission control signals to the plurality of emission lines, wherein the data driver, the scan driver and the emission driver are disposed in the peripheral area away from the display part.

11. A method of driving a display apparatus, the method comprising:

turning on a first transistor of the display apparatus, wherein the first transistor has four independent terminals;

applying a driving current corresponding to a data voltage to an organic light emitting diode of the display apparatus through the turned on first transistor;

sensing an operation temperature of the display apparatus; and determining whether a compensation voltage is applied to at least one of a fourth electrode of the first transistor and a fourth electrode of the third transistor based on the sensed operating temperature.

12. The method of claim 11, further comprising:

turning on a third transistor of the display apparatus, wherein the third transistor has four independent terminals; and compensating for the threshold voltage shift of the first transistor which is diode-connected by the turned on third transistor.

13. The method of claim 12, further comprising:

floating at least one of the fourth electrode of the first transistor and the fourth electrode of the third transistor when the operation temperature is less than the preset temperature; and applying a second compensation voltage to compensate for a threshold voltage shift to the at least one of the fourth electrode of the first transistor and the fourth electrode of the third transistor when the operation temperature is equal to or more than the preset temperature.

14. The method of claim 11, wherein when the threshold voltage is shifted toward a positive polarity at a high temperature, a level of the first compensation voltage decreases, and when the threshold voltage is shifted toward a negative polarity at the high temperature, the level of the first compensation voltage increases.

15. The method of claim 11, further comprising:

turning on a seventh transistor of the display apparatus; and applying an initial voltage to an anode electrode of an organic light emitting diode of the display apparatus through the turned on seventh transistor.

16. The method of claim 11, further comprising:

turning on a fourth transistor of the display apparatus; and initializing a previous data voltage charged in a capacitor of the display apparatus into an initial voltage through the turned on fourth transistor.

17. A pixel unit, comprising:

an organic light emitting diode;

a first transistor comprising a first electrode connected to a first node, a second electrode connected to a second node, and a third electrode connected to a third node;

a capacitor comprising a first electrode connected to a first voltage line and a second electrode connected to the first node;

a second transistor comprising a first electrode connected to a first scan line, a second electrode connected to a data line and a third electrode connected to the second node;

a third transistor comprising a first electrode connected to the first scan line, a second electrode connected to the first node and a third electrode connected to the third node; and a sixth transistor comprising a first electrode connected to an emission line, a second electrode connected to the third node and a third electrode connected to the organic light emitting diode, wherein at least one of the first and third transistors further comprises a fourth electrode, wherein the fourth electrode is connected to a compensation line through which a compensation voltage is provided under a preset condition based on a temperature.

18. The pixel unit of claim 17, wherein the compensation voltage is provided to the fourth electrode of the first transistor when an operating temperature of the first transistor exceeds a predetermined temperature.

19. The pixel unit of claim 17, wherein the compensation voltage is provided to the fourth electrode of the third transistor when an operating temperature of the third transistor exceeds a predetermined temperature.

20. The pixel unit of claim 17, further comprising:

a fourth transistor comprising a first electrode connected to a second scan line, a second electrode connected to the first node and a third electrode connected to a second voltage line;

a fifth transistor comprising a first electrode connected to the emission line, a second electrode connected to the first voltage line and a third electrode connected to the second node; and a seventh transistor comprising a first electrode connected to the first scan line, a second electrode connected to the second voltage line and a third electrode connected to the organic light emitting diode.

* * * * *